US010941789B2

(12) United States Patent
Kloft et al.

(10) Patent No.: US 10,941,789 B2
(45) Date of Patent: Mar. 9, 2021

(54) HYDROPNEUMATIC PISTON ACCUMULATOR

(71) Applicant: HYDAC TECHNOLOGY GMBH, Saar (DE)

(72) Inventors: Peter Kloft, Ransbach-Baumbach (DE); Herbert Baltes, Losheim (DE); Alexander Albert, Wallerfangen (DE)

(73) Assignee: HYDAC TECHNOLOGY GMBH, Sulzbach/Saar (DE)

( * ) Notice: Subject to any disclaimer, the term of this patent is extended or adjusted under 35 U.S.C. 154(b) by 156 days.

(21) Appl. No.: 16/310,878

(22) PCT Filed: Jun. 19, 2017

(86) PCT No.: PCT/EP2017/000705
§ 371 (c)(1),
(2) Date: Dec. 18, 2018

(87) PCT Pub. No.: WO2017/220196
PCT Pub. Date: Dec. 28, 2017

(65) Prior Publication Data

US 2020/0309158 A1 Oct. 1, 2020

(30) Foreign Application Priority Data

Jun. 25, 2016 (DE) ..... 102016007798.0
Jun. 25, 2016 (DE) ..... 102016007824.3

(51) Int. Cl.
*F16L 55/04* (2006.01)
*F15B 1/24* (2006.01)

(52) U.S. Cl.
CPC ..... *F15B 1/24* (2013.01); *F15B 2201/31* (2013.01); *F15B 2201/515* (2013.01)

(58) Field of Classification Search
CPC ..... F15B 1/24; F15B 2201/515
(Continued)

(56) References Cited

U.S. PATENT DOCUMENTS 2,800,924 A * 7/1957 Antrim, Jr. ..... B64D 47/00 138/31
3,043,340 A * 7/1962 Rehbock ..... F15B 1/24 138/31

(Continued)

FOREIGN PATENT DOCUMENTS

DE 71 03 342 1/1971
DE 103 10 427 9/2004

(Continued)

OTHER PUBLICATIONS

International Search Report (ISR) dated Sep. 22, 2017 in International (PCT) Application No. PCT/EP2017/000705.

*Primary Examiner* — James F Hook
(74) *Attorney, Agent, or Firm* — Wenderoth, Lind & Ponack, L.L.P.

(57) ABSTRACT

A hydropneumatic piston accumulator has an accumulator housing (1) defining a housing longitudinal axis (11) and a piston (9) longitudinally movable between two housing covers (5, 7) positioned opposite each other. In the housing (1), the piston (9) separates a working chamber (13) for a compressible medium, such as a working gas, from a working chamber (15) for an incompressible medium, such as hydraulic fluid. A piston part (55) of a displacement measurement device continuously determines each position of the piston (9) in the housing (1). A rod-shaped guide (29, 57) is stationarily positioned in the accumulator housing (1) and passes all the way through the piston (9) in each of its displacement positions in the accumulator housing (1). The piston (9) is movably guided along the guide until it reaches the stop on one of the two housing covers (5, 7) and is sealed against this guide (29,57) using a sealing device (49, 50).

15 Claims, 13 Drawing Sheets

(58) Field of Classification Search
USPC ..... 138/30, 31
See application file for complete search history.

(56) References Cited

U.S. PATENT DOCUMENTS

| | | | | | |
|---|---|---|---|---|---|
| 3,454,050 | A * | 7/1969 | Wolf | F15B 1/24 | 138/31 |
| 4,876,945 | A * | 10/1989 | Stoll | F15B 15/1457 | 92/5 R |
| 5,367,944 | A * | 11/1994 | Akeel | B05B 5/1625 | 91/1 |
| 6,412,476 | B1 * | 7/2002 | Thompson | B60K 15/077 | 123/516 |
| 7,234,490 | B2 * | 6/2007 | Dorr | F15B 1/24 | 138/26 |
| 7,270,318 | B2 * | 9/2007 | Lundahl | F16F 9/0281 | 267/119 |
| 2014/0261828 | A1 * | 9/2014 | Condon | F15B 1/24 | 138/31 |
| 2019/0120257 | A1 * | 4/2019 | Mannebach | F15B 1/24 | |

FOREIGN PATENT DOCUMENTS

| | | |
|---|---|---|
| DE | 10 2011 007 765 | 10/2012 |
| DE | 10 2011 090 050 | 7/2013 |
| DE | 10 2012 022 871 | 5/2014 |
| DE | 10 2013 009 614 | 12/2014 |
| DE | 10 2013 014 282 | 6/2015 |
| DE | 10 2014 105 154 | 10/2015 |
| JP | 60-143901 | 9/1985 |
| JP | 61-123201 | 8/1986 |
| JP | 62-97307 | 6/1987 |
| JP | 7-269503 | 10/1995 |

* cited by examiner

HYDROPNEUMATIC PISTON ACCUMULATOR

FIELD OF THE INVENTION

The invention concerns a hydropneumatic piston accumulator, comprising an accumulator housing that defines a longitudinal housing axis. A piston is longitudinally moveable between two opposite housing covers in the housing and separates inside the housing a working chamber for a compressible medium, such as a process gas, from a working chamber for an incompressible medium, such as hydraulic fluid. A piston part of a displacement measurement device continuously acquires the respective position of the piston inside the housing.

BACKGROUND OF THE INVENTION

Hydraulic accumulators, such as hydropneumatic piston accumulators, are used in hydraulic systems for the purpose of absorbing a certain volume of pressurised fluid, such as hydraulic oil, and to release it again to the system when required. In hydropneumatic piston accumulators commonly used today, the piston separates the oil-side working chamber from the working chamber filled with a process gas, such as $N_2$. The position of the piston changes so that the accumulator absorbs hydraulic oil when the pressure increases and compresses the gas in the other working chamber. As the pressure drops, the compressed gas expands and pushes the accumulated hydraulic oil back into the hydraulic circuit. As a result of the changing volumes in the working chambers during operation, the piston performs a corresponding axial movement.

In order for the accumulator to reliably operate as required, a prerequisite is that the pressure in the working chamber for the process gas is matched to the level of pressure present in the oil-side working chamber, so that the piston inside the accumulator housing is located in suitable positions and is then able to carry out the working movements between the end-positions of the piston inside the accumulator housing. The acquisition of the position that the piston assumes in the oil-side working chamber at a given fluid pressure makes it also possible to acquire the pressure level of the process gas in the respective working chamber and enables the monitoring of the piston accumulator with respect to its correct functionality.

Different solutions have been proposed for acquiring the position of the piston. For example, DE 10 2013 009 614 A1 discloses an ultrasonic displacement measuring system in which an ultrasonic sensor is used to determine the distance from the housing cover that adjoins the working chamber that contains the process gas to the side of the piston facing that housing cover. This solution is complicated since the measuring results of the acoustic logging require continuous error correction due to changes in the sound propagation speed in the gas-filled working chamber during operation. In a further known solution, which is disclosed in DE 103 10 427 A1, a series of magnetic field sensors is arranged on the outside along the accumulator housing, which sensors react to the field of a magnet arrangement that is disposed on the piston of the piston accumulator. This solution has the disadvantage that a magnetic strip containing the magnetic field sensors must be attached to the outside of the accumulator housing.

SUMMARY OF THE INVENTION

Based upon the described prior art, an object of the invention is to provide a hydropneumatic piston accumulator of the kind described at the outset, which has an improved displacement measuring device that makes the acquisition of the piston position possible in a particularly simple and advantageous manner.

According to the invention, this object is basically met by a piston accumulator having, as a significant feature of the invention, a stationary, rod-shaped guide disposed in the accumulator housing. The guide passes all the way through the piston in each of its displacement positions inside the accumulator housing guides the piston until the respective end stop at one of the two housing covers. The piston is sealed with respect to the guide through a sealing means. The reliable internal guidance of the piston, which, according to the invention, is provided through the rod-shaped guidance of the piston, ensures a more reliable and more accurate acquisition of measurements, while utilising different kinds of measuring methods known from prior art. At the same time the sealing means formed between piston and the rod-shaped guide, which creates a reliable separation of the media in the working chambers, provides a particularly reliable operational function of the piston accumulator also during the measurement acquisition process.

Advantageous displacement measuring devices that may be used are optical measuring systems such as laser measuring systems, acoustic measuring systems such as an ultrasonic measuring system such as a magnetic measuring system, and inductive measuring system, such as a Hall sensor measuring system or a magnetostrictive measuring system. A corresponding laser measuring system may be applied as is described in the documents DE 10 2011 007 765 A1 or DE 10 2014 105 154 A1. A system using an ultrasonic measuring device may be used as is described in document DE 10 2013 009 614 A1.

In particularly advantageous exemplary embodiments, the rod-shaped guide inside the accumulator housing may at least partially be made in form of a hollow rod and may house further components of the displacement measuring device, such as a waveguide of a magnetostrictive measuring system or a chain of Hall sensors of a sensor measuring system. Alternatively, the piston guide may be formed directly from further parts of the respective displacement measuring device, such as the waveguide of the magnetostrictive measuring system. Designing the rod-shaped guide as a hollow rod is particularly advantageous when utilising optical and acoustic measuring systems since the inside of the hollow rod provides a space for transmitted and reflected optical or acoustic radiation that is separated from the working chambers. Since in this instance the propagation velocity is not influenced by conditions such as pressure and temperature, as would be the case for the propagation of free ultrasonic waves or free laser radiation through media with changing sound velocity or optical permeability, the measuring result is not influenced by changing media states as is the case in the prior art described earlier.

For the rod-shaped guide, such as the hollow rod, a lead-through with a permanent magnet device may preferably be provided in the piston that extends coaxially to the longitudinal axis. The permanent magnet device may act as position encoder in a Hall sensor measuring system, as well as in a magnetostrictive measuring system.

In a magnetostrictive measuring system the rod-shaped guide may be formed through an electrically non-conductive jacket element that directly surrounds the instrument wire. In that jacket element, which may for example be made from a synthetic material, an electrical return conductor may also be embedded to conduct the current pulse that triggers the measuring process. The electrical return conductor is covered by a further protective layer that forms the outside of the round strand, which forms the rod-shaped guide.

In particularly advantageous exemplary embodiments, the hollow rod that forms the rod-shaped guide is preferably made from a preferably pressure-resistant, circular cladding tube. The cladding tube is preferably made from a non-magnetic, metallic material. The smooth outer surface facilitates the provision of a smooth-running guide through the piston in its displacement movements.

A particularly advantageous design may be in which the accumulator housing is provided with a cylindrical tube, which is closed at both ends by a housing cover. The cladding tube is attached with at least one open end to one of the housing covers. A pulse converter with a pulse transmitter/receiver, which is connected to the waveguide of the magnetostrictive measuring system, is disposed on that one of the housing covers.

In an ultrasonic measuring system, it is possible to movably guide a position encoder inside the cladding tube, which encoder follows the piston movements due to the magnetic force of the permanent magnet device that acts between the position encoder and the piston. A transmitter/receiver of the displacement measuring device is disposed on one of the housing covers, which transmits through the respective open end of the cladding tube measuring radiation to the position encoder and receives reflected radiation from it. Since through the cladding tube a space that is separated from the media in the working chambers of the piston accumulator is available for the measuring radiation, interference in the measuring result caused in the prior art by condition changes in the media is no longer applicable. This advantage is still applicable even when a laser measuring system is used because, in contrast to the prior art, a kind of condensate (mist) can form when severe, dynamic temperature changes occur. The mist influences the laser measurement. In contrast, an undisturbed space for the measuring radiation is available in the invention.

The cover that receives the open end of the cladding tube advantageously adjoins the gas-end working chamber. This cover offers the advantage that the pulse converter of the respective sensor system can also be disposed on the housing cover of the gas-end working chamber that receives the open end of the cladding tube. The opposite housing cover then remains free for the pipe connections to the associated hydraulic system (not shown). Alternatively, the cladding tube may also be open at its unattached, free end or it may be closed at its unattached, free end. In the latter instance, pressure equalisation between the inside of the tube and the working chamber may take place at the free end of the tube so that no great demands are placed on the pressure-resistance of the cladding tube. In the second instance, where the cladding tube is closed at its free end, the inside of the tube may have no pressure applied so that the mounting provided for the pulse converter on the housing cover with its passage through to the inner space of the tube does not require any special seal.

Alternatively, it is possible to attach the cladding tube at both open ends to a housing cover each.

This design provides the advantageous option that, starting from both open ends of the cladding tube, the waveguide of each sensor system extends along part of the length of the measuring distance inside the cladding tube. This structure provides the opportunity to cover the entire measuring distance with two shorter sensor systems in instances where very long piston accumulators are used.

In further alternative exemplary embodiments, the cover that retains the open end of the cladding tube may adjoin the oil-side working chamber. The hydraulic oil connection may in this instance be disposed, axially offset, on the cover beside the centrally arranged mounting for the pulse converter of the sensor system.

In an advantageous manner, the respective sensor system may be designed as a component that is removable from an open end of the cladding tube, which has a preferably rollable, flexible jacket that envelopes the waveguide like a tube. Thus, one and the same magnetostrictive sensor system may be used for monitoring multiple piston accumulators. The sensor system only remains in the respective piston accumulator for a certain measuring period and, when completed, is removed from the piston accumulator.

Other objects, advantages and salient features of the present invention will become apparent from the following detailed description, which, taken in conjunction with the drawings, discloses preferred embodiments of the present invention.

BRIEF DESCRIPTION OF THE DRAWINGS

Referring to the drawings that form a part of this disclosure.

DETAILED DESCRIPTION OF THE INVENTION

Figure 1:
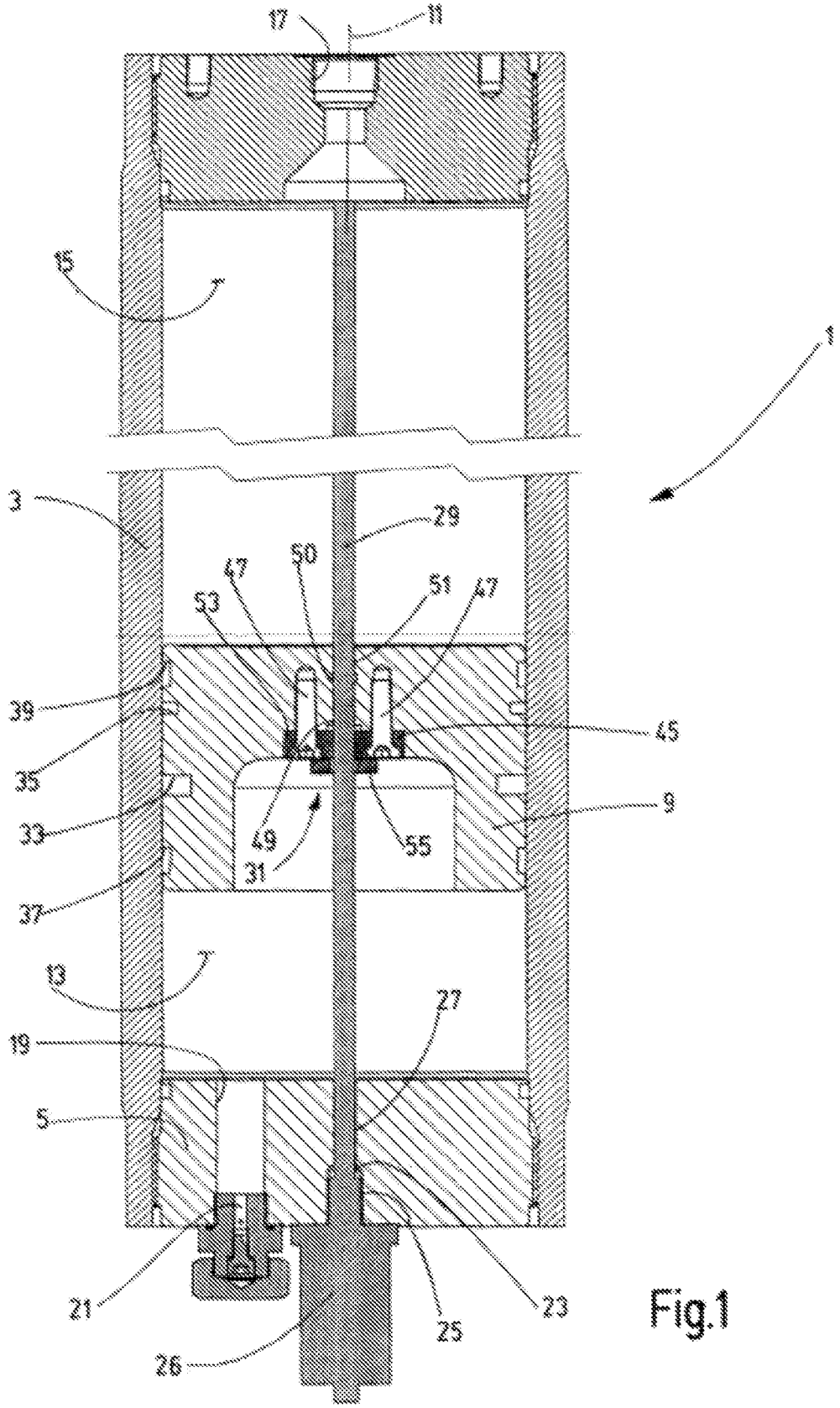
FIG. 1 is a side view in section of a piston accumulator according to a first exemplary embodiment of the invention, shown in shortened form.

The invention will now be explained by way of examples depicted in FIGS. 1 to 12 in which the piston accumulator is fitted with a magnetostrictive measuring system. FIG. 13 shows an exemplary embodiment with an ultrasonic measuring system.

The exemplary embodiments of the piston accumulator according to the invention shown in the drawings comprise an accumulator housing 1, which in all the exemplary embodiments shown has a cylindrical pipe 3 as a main part that forms a round, hollow cylinder. The cylindrical pipe 3 is tightly closed at both ends by screwed-in housing covers 5 and 7, between which a piston 9 is freely moveable along the longitudinal housing axis 11. The piston 9 separates a gas-side working chamber 13, which is filled to a certain filling pressure with a process gas, such as $N_2$, as a compressible medium, from a working chamber 15, which is filled with an incompressible medium, such as hydraulic oil. To connect said working chamber 15 to an associated hydraulic system (not shown), a connecting port 17 is disposed coaxial to the longitudinal axis 11 in the housing cover 7 that adjoins the oil-side working chamber 15. At the opposite housing cover 5, which adjoins the gas-side working chamber 13, a filling passage 19 is provided, offset from the longitudinal axis 11, at the outer end of which a fill valve 21 of the usual kind is disposed, through which a certain quantity of process gas may be introduced into the working chamber 13 under a certain filling pressure.

A sensor port 23 is provided, arranged coaxial to the longitudinal axis 11, in the housing cover 5 that adjoins the gas-side working chamber 13. The sensor port 23 is provided at the outer end section with a seat for a screw connector of the pulse converter 26, as well as a passage 27, through which the strand 29 of the jacket elements of the waveguide extends along the longitudinal axis 11 and through a lead-through 31 provided in piston 9 and along the length of the measuring distance in the direction of the other housing cover 7. In this first exemplary embodiment according to the invention, the strand 29 forms the strand-shaped internal guide for the separating piston 9.

Figure 2:
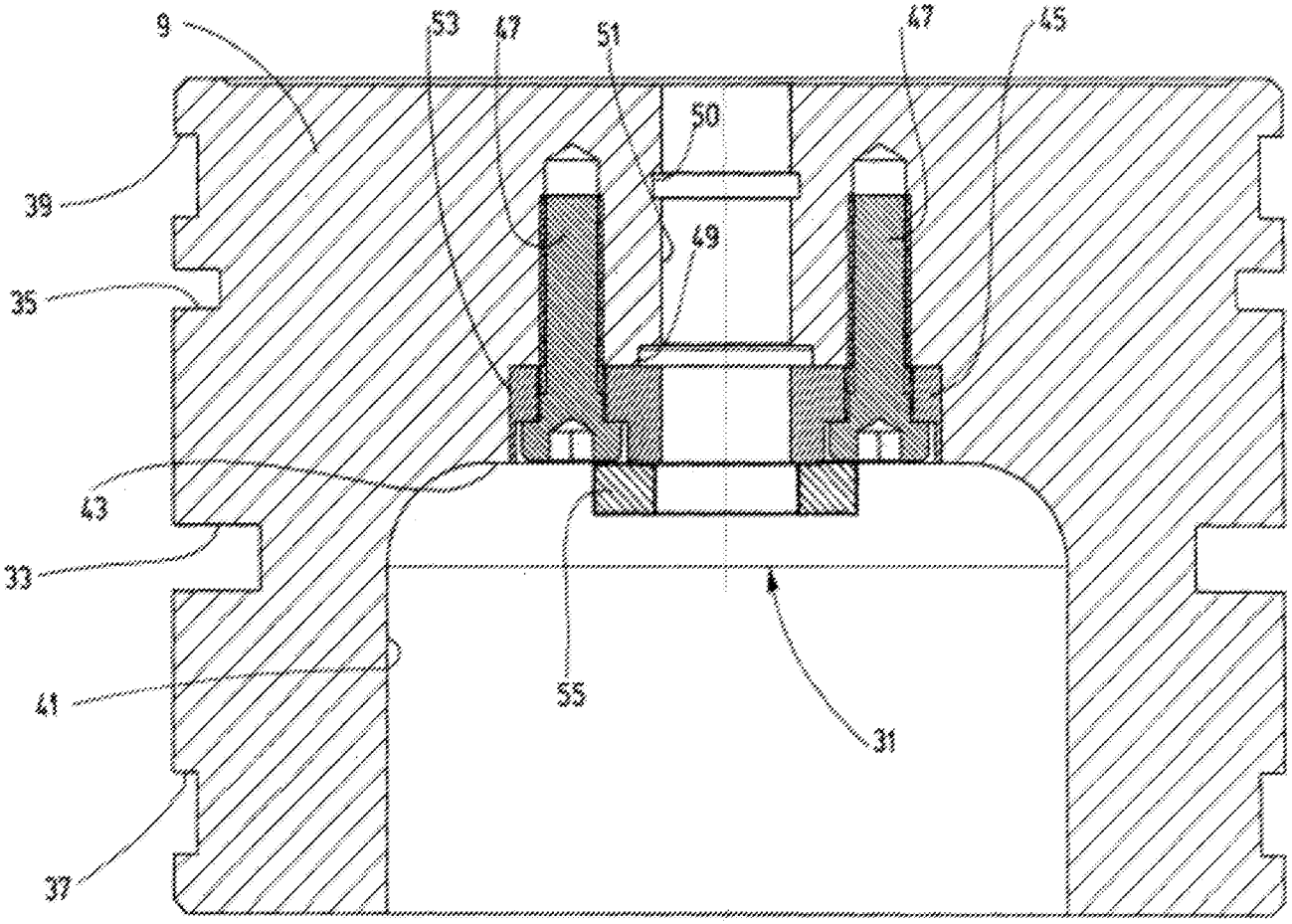
FIG. 2 is an enlarged side view in section of the piston of the piston accumulator of FIG. 1.

FIG. 2, which depicts the piston 9 in enlarged form compared to FIG. 1 and which corresponds approximately to the size of an actual implementation, clearly shows details of the central lead-through 31. As is common practice with such accumulator pistons, the piston 9 is provided at its outer circumference with an external seal between the fluid chamber and the media chamber in the form of annular grooves 33 and 35 for piston seals (not shown), as well as annular grooves 37 and 39 of reduced depth for guide strips (also not shown) and which are offset with respect to the annular grooves 33 and 35 in the direction towards the two axial end sections. As is also common practice with such pistons, the piston 9 is provided with a circular, pot-shaped recess 41 inside the accumulator housing on the side of the piston that faces the gas-side working chamber 13. The flat bottom 43 of the recess 41 is located approximately at half the axial length of the piston 9. The lead-through 31 is provided with through-hole 51, which extends coaxially to the longitudinal axis 11 from the bottom 43 to the end face of the piston. In the section of the borehole adjacent to bottom 43 the through-hole 51, a circular-cylindrical expansion 53 is provided. Expansion 53 forms the seat for an annular body 45, which is attached inside the expansion 53 by screws 47 that extend parallel to the through-hole 51. Annular grooves 49 and 50 are formed in the non-expanded part of through-hole 51 to retain sealing rings as part of the internal seal arrangement.

The annular body 45, which is attached inside the expansion 53, forms the support for the permanent magnet device that serves as position encoder. The permanent magnet device is formed by a magnetic ring 55, which is attached by adhesive to the free surface of the annular body 45, which free surface is flush with the bottom 43. The internal diameter of the magnetic ring 55, which is disposed coaxially to through-hole 51, is marginally larger than the diameter of through-hole 51. In order to magnetically decouple the magnetic ring 55 from the metallic piston 9, the screws 47 and the annular body 45 are made from a thermosetting synthetic material.

Figure 3:
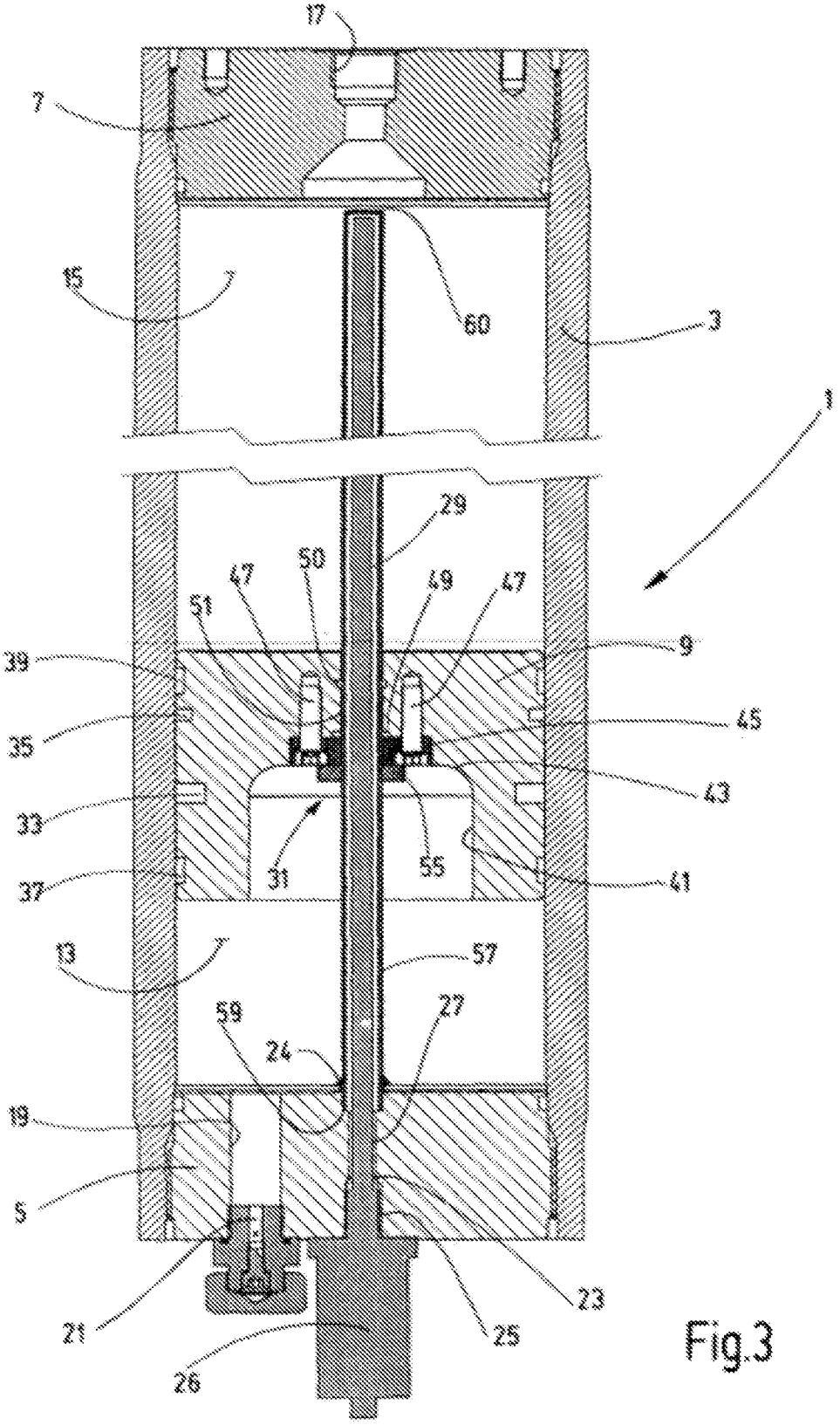
FIG. 3 is a side view in section of a piston accumulator according to a second exemplary embodiment of the invention, shown in shortened form.
Figure 4:
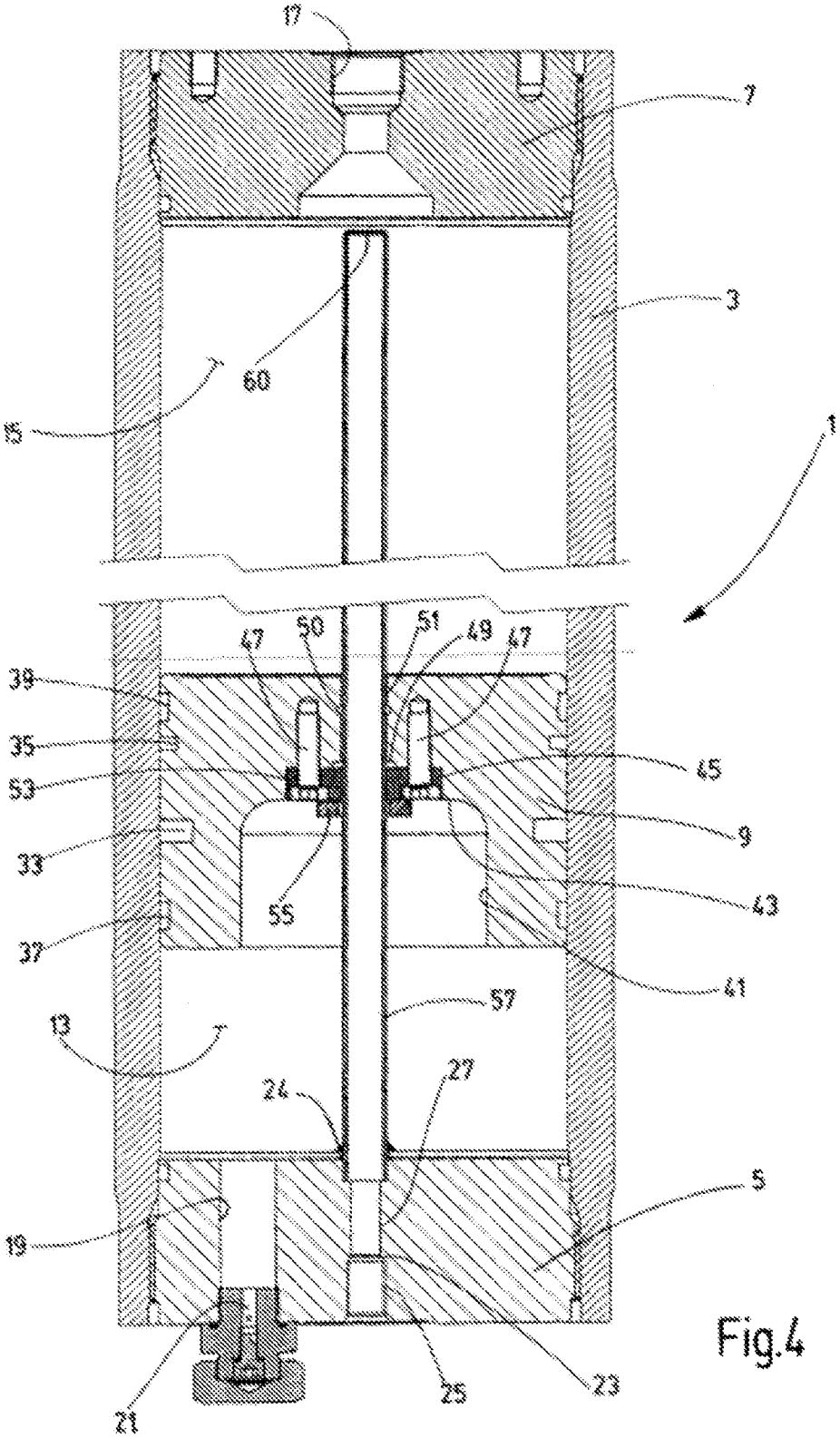
FIG. 4 is a side view in section of the exemplary embodiment in FIG. 3, wherein only the outer jacket element of the magnetostrictive sensor system in form of a cladding tube is shown in shortened form.

FIGS. 3 and 4 depict a second exemplary embodiment of the piston accumulator according to the invention. As the outer jacket element that surrounds the jacket elements that form the strand 29, a cladding tube 57 is provided. Cladding tube 57 is attached with its one open end 59 to the cover 5, which is adjacent to the gas-side media chamber 13, by a solder or welding connection 24 in such a way that the open end 59 protrudes into the passage 27 of the sensor port 23. The cladding tube 57 is closed at the opposite end 60 and is spaced from and not connected to the accumulator housing 1 and the covers 5, 7. By making the cladding tube 57 pressure-resistant, for example from a non-magnetic, metallic material, the inside of the tube remains unpressurised, regardless of the accumulator pressure that exists in the working chambers 13, 15, so that no great demands need to be placed on the seal on seat 25 of the sensor port 23. The smooth surface of the cladding tube 57 facilitates at the same time the smooth-sliding guidance of piston 9 at the lead-through 31, and thus, an advantageous operating response of the piston accumulator. The cladding tube 57 forms the rod guide for the piston 9.

Figure 5:
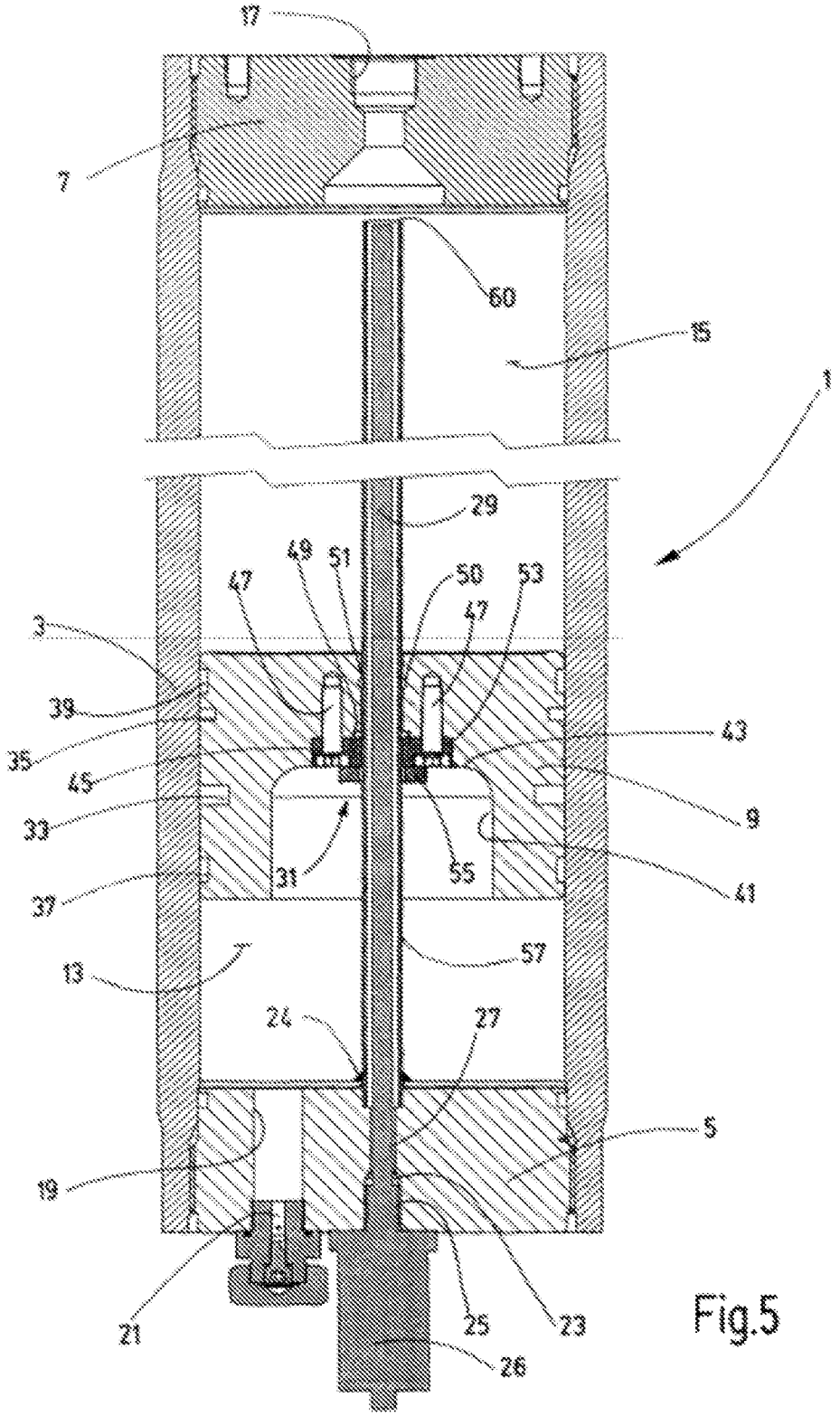
FIG. 5 is a side view in section of a piston accumulator according to a third exemplary embodiment of the invention, shown in shortened form.
Figure 6:
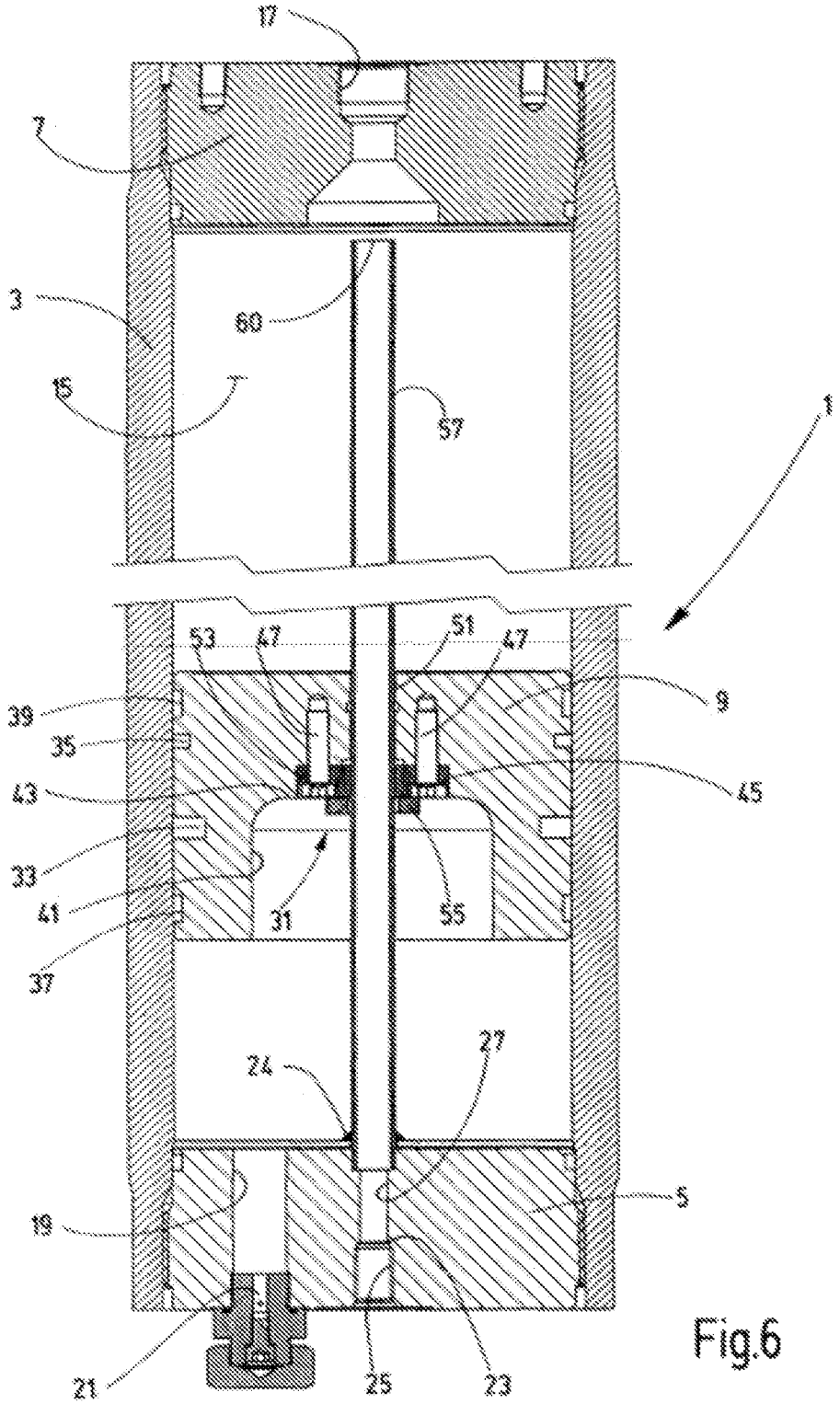
FIG. 6 is a side view in section of a piston accumulator according to the third exemplary embodiment, shown in shortened form, wherein only the outer jacket element in form of a cladding tube is shown of the sensor system.

The third exemplary embodiment depicted in FIGS. 5 and 6 differs from the above-described example of FIGS. 3-4 only in that the end 60 of the cladding tube 57 is also open, which end 60 is adjacent to housing cover 7 of the oil-side working chamber 15. This opening ensures that the inside of the cladding tube 57 has equal pressure with respect to the working pressure of the accumulator so that the cladding tube 57 in form of the rod guide does not need to be made pressure-resistant. Apart from a non-magnetic metal tube, it is therefore also possible to use a plastic tube.

Figure 7:
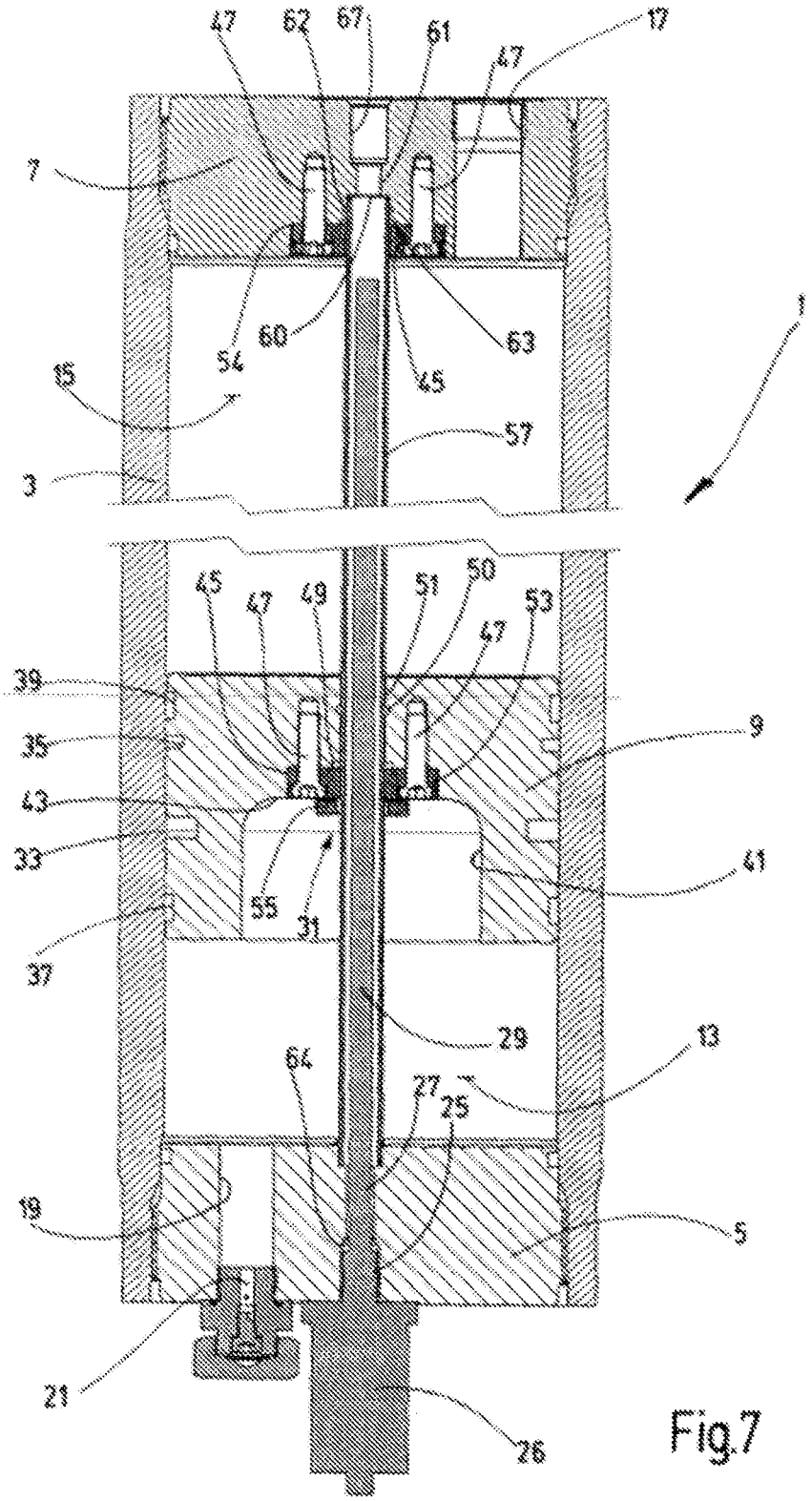
FIG. 7 is a side view in section of a piston accumulator according to a fourth exemplary embodiment of the invention, shown in shortened form.
Figure 8:
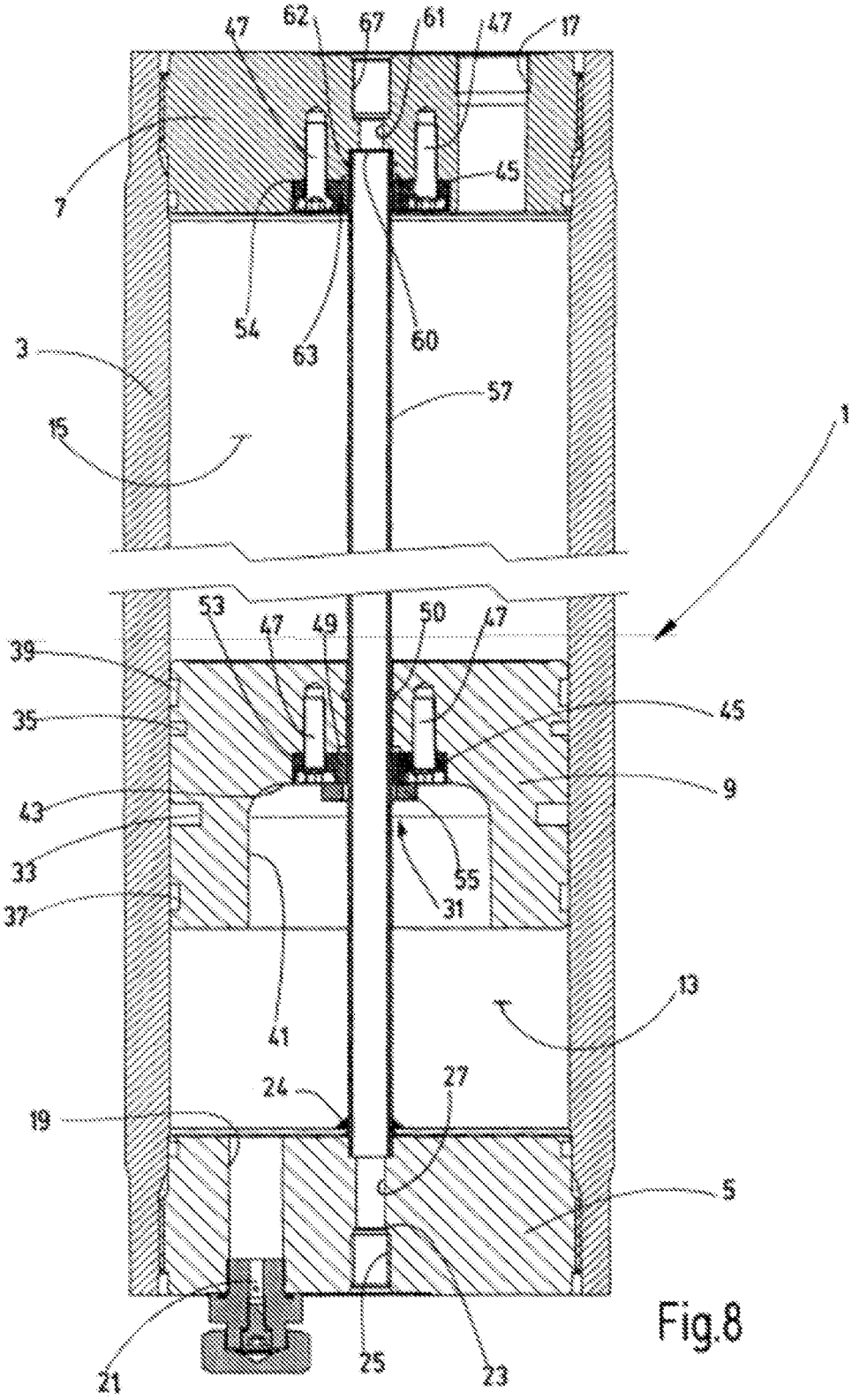
FIG. 8 is a side view in section of the fourth exemplary embodiment, shown in shortened form, wherein only the outer jacket element in form of a cladding tube is shown of the sensor system.

FIGS. 7 and 8 depict a fourth exemplary embodiment in which the cladding tube 57 with its open end 60 does not end just before the housing cover 7, which is provided with the oil-side connecting port 17, but is retained in a centrally located through-hole 61 in the housing cover 7. As is the case for the through-hole 51 located in the lead-through 31 of piston 9, the through-hole 61 is also stepped in longitudinal direction. At the inner end section of through-hole 61, an expansion 54 is formed, which expansion 54 corresponds in shape and size to the expansion 53 in piston 9. Like in piston 9, the same annular body 45, as is used in piston 9, is inserted into the expansion 54 and also secured with screws 47. The end part of the cladding tube 57 that passes through the annular body 45 is sealed inside the through-hole 61 by sealing rings 62 and 63. The connecting port 17, which is provided as access to the oil-side working chamber 15, is arranged in this exemplary embodiment in a position that is radially offset from the longitudinal axis. In this arrangement of the cladding tube 57, with the through-hole 61 open to atmosphere, the cladding tube 57 is again unpressurised so that at the passage 27, which leads to the seat 25 of the pulse converter 26, and at the sensor port 23 no particularly pressure-resistant seal arrangement needs to be provided. By providing a correspondingly pressure-resistant seal arrangement 64 at the seat 25, it is possible to provide a fluid connection (not shown) between connecting port 17 and the through-hole 61 on the housing cover 7 with its connecting port 17 so that the accumulator pressure is also in this exemplary embodiment present on the inside of the cladding tube 57. It is therefore pressure-equalised as in the exemplary embodiment of FIGS. 5 and 6.

Figure 9:
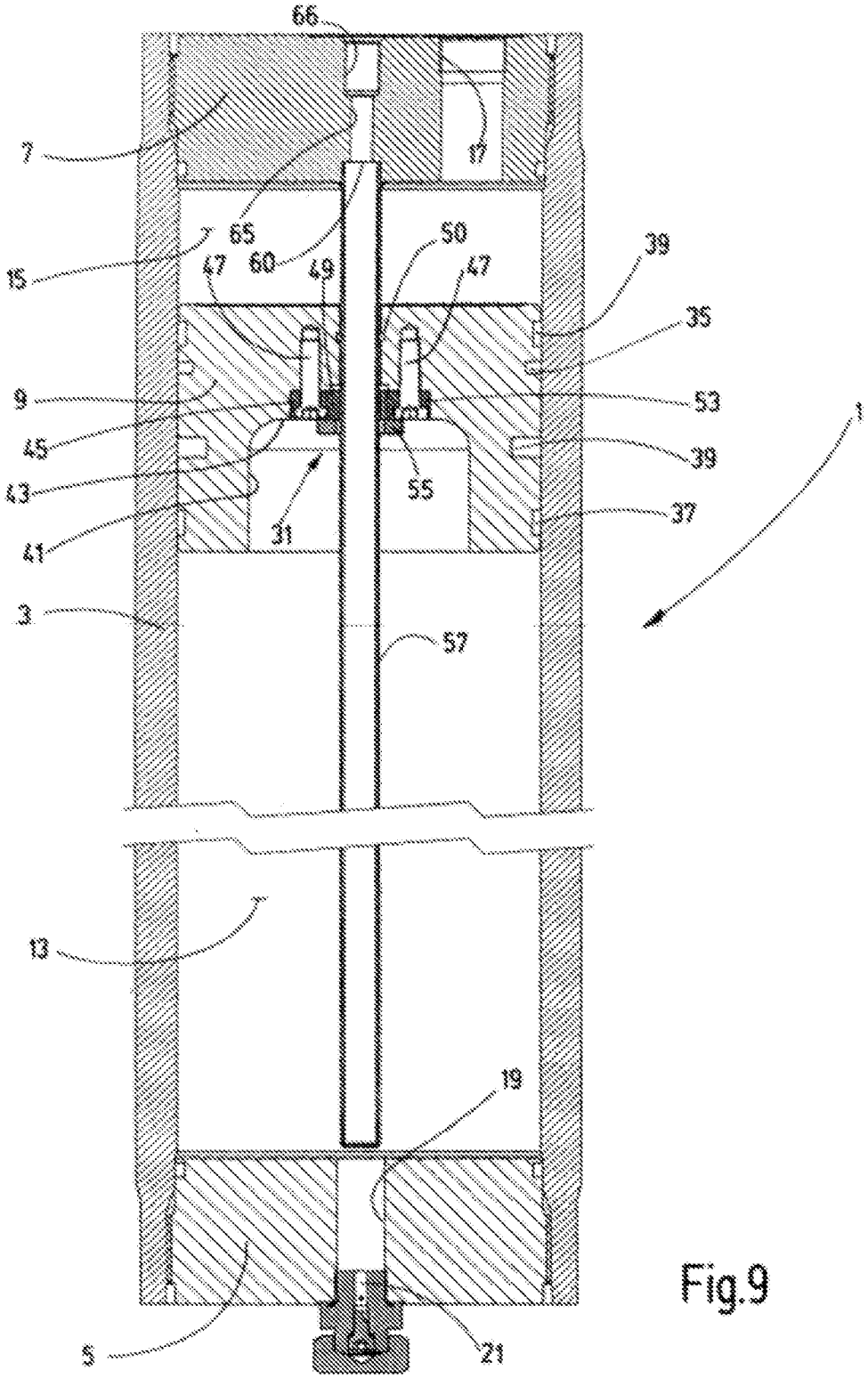
FIG. 9 is a side view in section of a piston accumulator according to a fifth exemplary embodiment of the invention, shown in shortened form, wherein only the outer jacket element in form of a cladding tube is shown of the sensor system.

FIG. 9 depicts a fifth exemplary embodiment that is equivalent to that of FIGS. 3 and 4 with the exception that a passage 65 and a seat 66 are provided on the oil-side of housing cover 7 for the pulse converter 26 (not shown in this Figure). The open end 60, which is attached to cover 7, protrudes into the passage 65. As in FIGS. 7 and 8, the connecting port 17 for the oil-side working chamber 15 is radially offset from the longitudinal axis.

Figure 10:
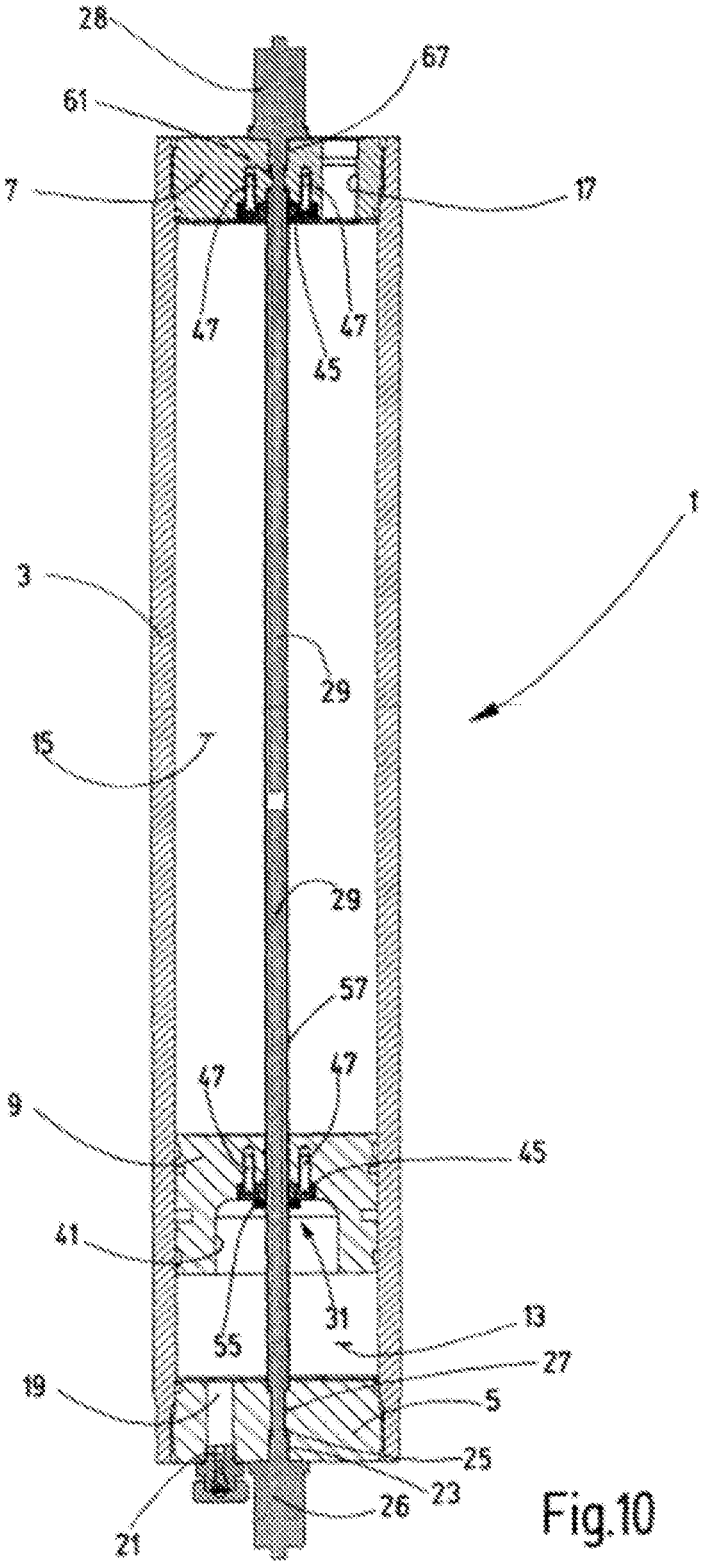
FIG. 10 is a side view in section of a piston accumulator according to a sixth exemplary embodiment of the invention.

FIG. 10 depicts a sixth exemplary embodiment with a very long accumulator housing 1. The design of the gas-side housing cover 5 and that of the oil-side housing cover 7 corresponds in this example to the cover design of FIGS. 7 and 8 respectively, wherein the cladding tube 57 is attached to said covers 5, 7 with both open ends. To avoid covering the long length of the measuring distance inside accumulator housing 1 with a single sensor system, a seat for a sensor port 23 is provided on the gas-side cover 5 as well as on the oil-side cover 7. The stepped through-hole 61, shown in FIGS. 7 and 8, forms in the expanded end section 67 a seat for a second pulse converter 28. In this manner the pulse converters 26 and 28 with their respective strand 29, which contains the wave guide, cover half of the long measuring distance each.

Figure 11:
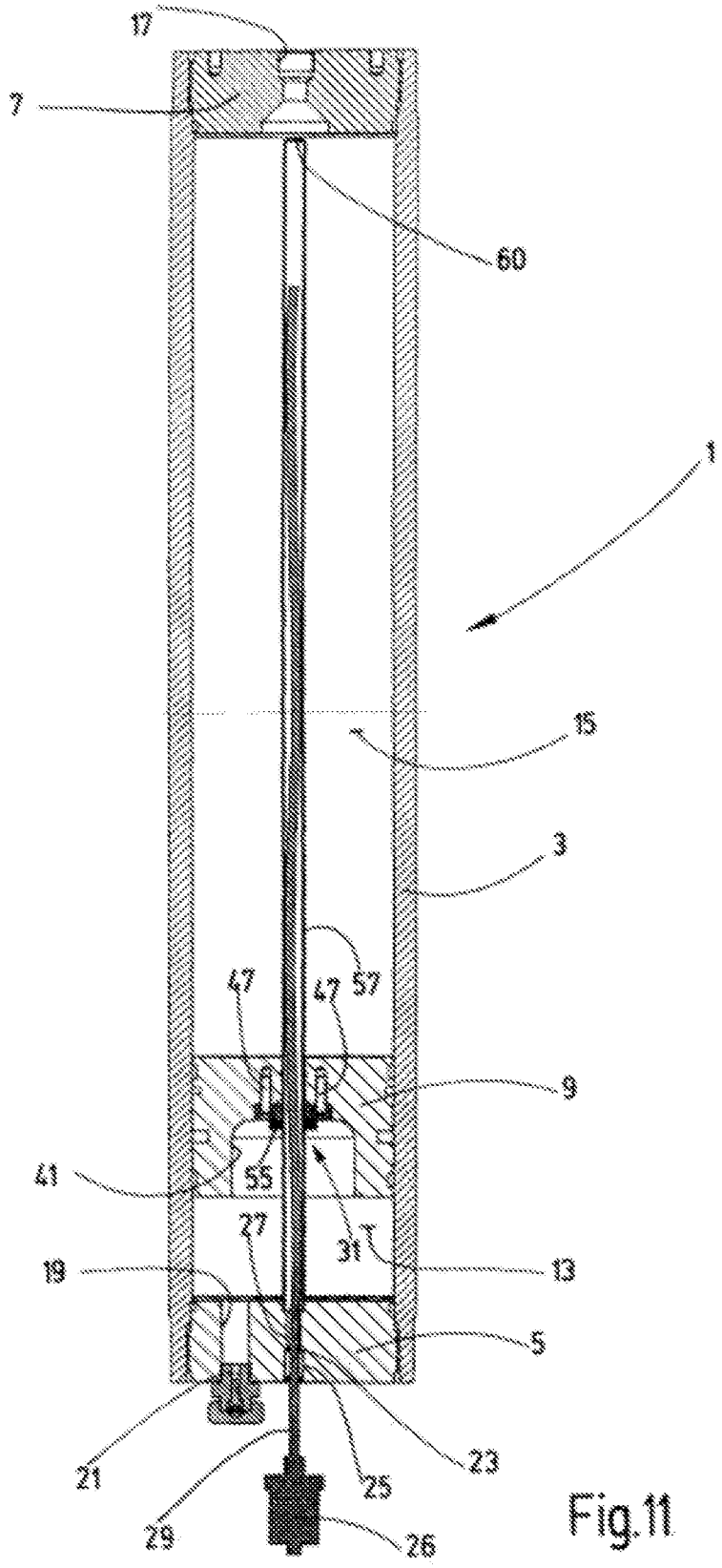
FIGS. 11 & 12 are side views in section of a piston accumulator according to a seventh exemplary embodiment of the invention, wherein the sensor system with its inner jacket elements is shown pulled out at different lengths from the outer jacket element, which is formed by a cladding tube.
Figure 12:
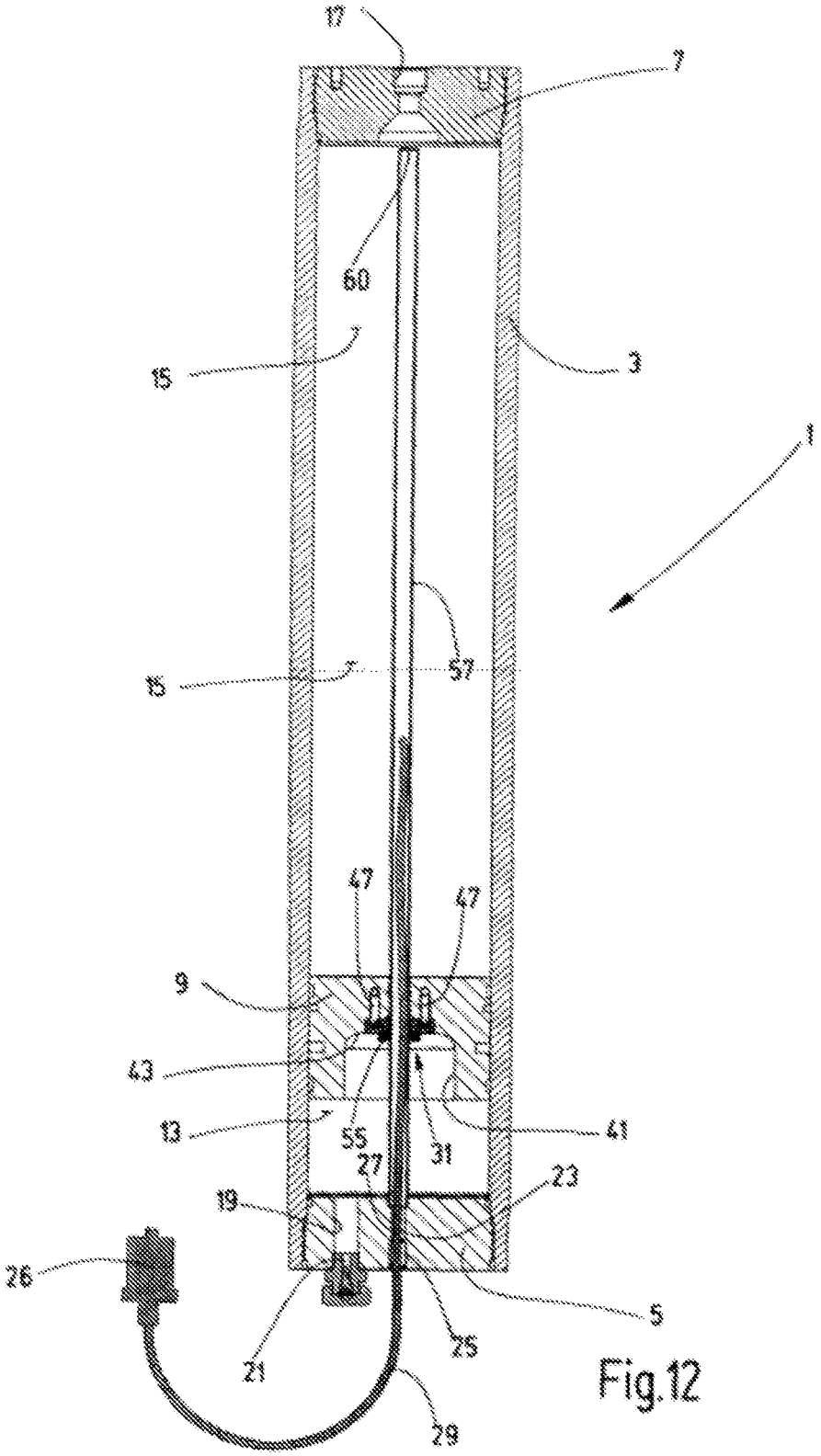
Figure 13:
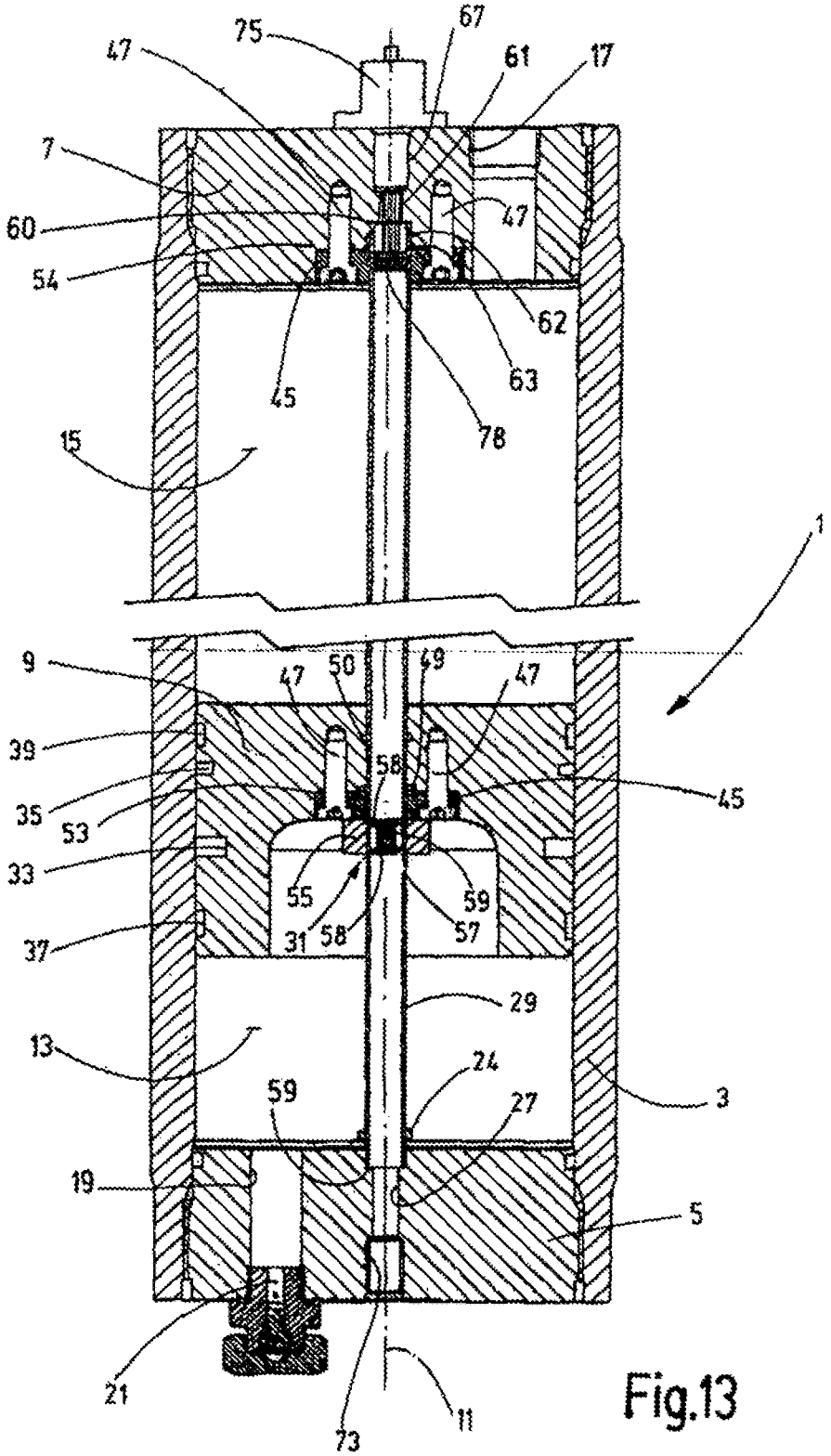
FIG. 13 is a side view in section of a piston accumulator according to an eighth exemplary embodiment of the invention, shown in a shortened form.

The design in the seventh exemplary embodiment shown in FIGS. 11 and 12 corresponds to the example of the accumulator housing 1 of FIGS. 3 and 4. The strand 29 that contains the wave guide of the sensor system is flexible since the jacket elements are made from an elastomer. After pulling it out of the cladding tube 57, which is closed at the free end 60 and is therefore unpressurised, the strand 29 may be pulled out and rolled up without interrupting the operation of the piston accumulator as soon as a certain measuring period is concluded. The sensor system can then be used to monitor multiple piston accumulators by inserting it into passage 27 that is provided in housing cover 5.

In the eighth exemplary embodiment of FIG. 13, which is provided with an ultrasonic measuring system, the position encoder takes the form of a single round body made from a ferromagnetic material with a flat circular disk 58 at both axially opposite ends. The position encoder is moveably guided inside cladding tube 57 at the outer diameter of the circular disk 58. The disks 58 are attached to each other with a single connecting piece 59 of a reduced diameter. The axial distance of disks 58 is matched to the axial height of the magnetic ring 55 in such a way that the end faces of the disks 58 are flush with the end faces of the magnetic ring 55 so that an optimal magnetic flux is formed with the magnetic ring 55. The end face of the disk 58 of the position encoder, which faces the end 60 of the cladding tube 57, forms the reflecting surface for the measuring radiation that enters at the end 60 into the cladding tube 57. Through the displacement movement of the piston 9 the position encoder is "dragged along" through said magnetic force so that the respective location of the position encoder corresponds to the location of piston 9.

The stepped through-hole 61 of housing cover 7, which retains the end 60 of the cladding tube 57, is also provided with a circular-cylindrical expansion 54, in the same manner as for through-hole 51 at the lead-through 31 of piston 9. The same annular body 45 is used for the lead-through 31 of piston 9, is provided in form of a plastic body, and is retained and secured with screws 47. The annular body 45 forms on housing cover 7 a suitable retainer for the inserted end section of the cladding tube 57. For the ultrasonic measuring method the displacement measuring device is provided with a transmitter/receiver 75 for which the outer, expanded through-hole section 67 of through-hole 61 in the oil-side housing cover 7 forms a seat. An ultrasonic transducer with a disk-shaped piezoelectric ceramic 78 extends from the through-hole section 67 into the end section of tube 57 to ascertain the distance to the reflective surface on the facing disk 58 of the position encoder. Alternatively, it would be possible to dispose the transmitter/receiver 75 on the gas-side housing cover 5, wherein the expanded through-hole section 73 at the end of the passage 27 could form the seat for the displacement measuring device.

Instead of an ultrasonic transmitter/receiver 75, a laser radiation may be used. The position encoder is then preferably provided at its upper end with a reflective surface suitable for laser light, which reflects the laser radiation emitted by the transmitter 75 to the receiver 75. From the elapsed time differences, it is then possible to determine the position of piston 9 and, if applicable, its displacement velocity and/or the acceleration values when accelerating and decelerating. Moreover, it is also possible to insert into the rod-shaped guide in form of the hollow tube or cladding tube 57 the sensor chain of a Hall sensor measuring system, for example as described in DE 10 2013 014 282 A1, instead of a magnetostrictive conductor in form of a strand 29.

It is also possible to house parts of a magnetic or inductive measuring system, as described in DE 103 10 427 A1 and DE 10 2011 090 050 A1, in the pressure-resistant, rod-shaped guide in form of the hollow tube or cladding tube 57.

In the position measurement to be carried out, the piston 9 constitutes an important component in the overall measuring system and carries parts of the same or drags them along via magnetic coupling when it moves. Moreover, the hollow guide rod 57 also houses parts of the overall measuring system, as described. In the exemplary embodiments shown, the rod-shaped guide is disposed coaxial to the longitudinal axis 11 inside accumulator housing 1. Nevertheless, it is also possible to arrange the guide, which passes through piston 9, offset from the center and parallel to the longitudinal axis 11 inside accumulator housing 1. It is, moreover, conceivable to dispose multiple guide rods parallel to each other inside accumulator housing 1. Depending on the number of guide rods used, the separating piston 9 requires the corresponding number of passages for the respective guides. Furthermore, each respective guide rod passes through the inside of the accumulator housing 1 between its two housing covers 5, 7 and is also disposed coaxial to accumulator housing 1.

The sealing means or seals 49, 50 between guide rod and piston 9 is effective in every displacement position of the piston 9. The two sealing rings that are retained in annular grooves 49, 50 surround and are in contact with the guide rod. The two sealing rings retained in the annular grooves 49, 50 are at a predeterminable axial distance in the direction of the longitudinal axis 11. As part of the internal guidance of the piston 9, the seals stabilise its axial displacement movement along the guide rod 29, 57. The sealing means 49, 50 is disposed on the inside of the piston 9. When viewing the drawing, the seals above the annular body 45 that is screw-fastened into the piston 9. The internal guidance of the piston 9 through the sealing means 49, 50 in conjunction with the outer guidance along the inner wall of the accumulator housing 1 with the respective outer sealing means 33, 35 result in an accurate displacement movement of the piston 9 inside the accumulator housing 1, which leads to improved measuring results when detecting the position of piston 9 and its actual movement states.

While various embodiments have been chosen to illustrate the invention, it will be understood by those skilled in the art that various changes and modifications can be made therein without departing from the scope of the invention as defined in the claims.

The invention claimed is:

1. A hydropneumatic piston accumulator, comprising:

an accumulator housing defining a longitudinal axis, having first and second covers on opposite longitudinal ends of said accumulator housing, and having a first chamber for receiving a compressible medium and a second chamber for receiving an incompressible medium;

a piston longitudinally movable in said accumulator housing and separating said first and second chambers from each other;

a displacement measurer coupled to said accumulator housing and capable of continually acquiring positions of said piston in said accumulator housing;

a rod-shaped guide being stationarily mounted inside said accumulator housing and extending through said piston in every displacement position of said piston in said accumulator housing, said piston being guided for movement in said accumulator housing between and up to said first and second housing covers, said guide being a hollow rod forming a pressure-resistant circular cylindrical cladding tube having a free first end that is closed door or open and that spaced from and is not connected to said accumulator housing and to said first and second covers and;

seals extending between and engaging said piston and said guide.

2. A hydropneumatic piston accumulator according to claim 1 wherein said displacement measurer comprises at least one of an optical measuring system, a laser measuring system, an acoustic measuring system, an ultrasonic measuring system, a magnetic measuring system, an inductive measuring system, a Hall sensor measuring system, or a magnetostrictive measuring system.

3. A hydropneumatic piston accumulator according to claim 2 wherein said displacement measurer comprises at least one of a waveguide of the magnetostrictive measuring system or a Hall sensor chain of the Hall sensor measuring system.

4. A hydropneumatic piston accumulator according to claim 1 wherein a component of said displacement measuring device directly forms said guide.

5. A hydropneumatic piston accumulator according to claim 4 wherein said component comprises a waveguide of a magnetostrictive measuring system.

6. A hydropneumatic piston accumulator according to claim 1 wherein said guide extends through a lead-through in said piston; and a permanent magnet is on said piston at said lead-through.

7. A hydropneumatic piston accumulator according to claim 6 wherein said lead-through extends coaxially to said longitudinal axis.

8. A hydropneumatic piston accumulator according to claim 1 wherein said displacement measurer comprises a magnetostrictive measuring system with a measuring wire; and said cladding tube is made of electrically non-conductive material and directly surrounds said measuring wire.

9. A hydropneumatic piston accumulator according to claim 1 wherein said accumulator housing comprises a cylindrical tube closed at longitudinal ends thereof by said first and second covers;

said cladding tube having an open second end and being fixed to said first cover and being opposite said first end; and said displacement measurer comprises a pulse converter being on said first housing cover, being connected to a waveguide of a magnetostrictive measuring system and being provided with a pulse transmitter/receiver.

10. A hydropneumatic piston accumulator according to claim 1 wherein said displacement measurer comprises at least one of an ultrasonic measuring system or a laser measuring system and a position encoder moveably guided in said cladding tube, said piston encoder following movement of said piston due to the magnetic force of a permanent magnet on said piston; and said displacement measurer comprises a transmitter/receiver on one of said first and second covers, said transmitter/receiver transmitting measuring radiation passing through an open end of said cladding tube to said position encoder and receiving radiation reflected by said position encoder.

11. A hydropneumatic piston accumulator according to claim 1 wherein said first cover receives an open second end of said cladding tube and adjoins said first chamber with said compressible medium being a gas.

12. A hydropneumatic piston accumulator according to claim 11 wherein said flexible sheath is capable of being rolled up and surrounds a waveguide in a manner of a hose.

13. A hydropneumatic piston accumulator according to claim 1 wherein said displacement measurer comprises a sensor component retrievable from an open second end of said cladding tube, said sensor component having a flexible sheath.

14. A hydropneumatic piston accumulator according to claim 1 wherein said free first end of said cladding tube is closed.

15. A hydropneumatic piston accumulator according to claim 1 wherein said free first end of said cladding tube is open.

* * * * *